US006263525B1

(12) United States Patent
Liu

(10) Patent No.: US 6,263,525 B1
(45) Date of Patent: Jul. 24, 2001

(54) FOLDABLE FRAME OF A PLAYPEN

(76) Inventor: Mei-Ling Liu, 3rd Fl., No. 35, Sec. 1, An-Ho Rd., Taipei (TW)

( * ) Notice: Subject to any disclaimer, the term of this patent is extended or adjusted under 35 U.S.C. 154(b) by 0 days.

(21) Appl. No.: 09/521,934

(22) Filed: Mar. 9, 2000

(51) Int. Cl.[7] ..... A47D 13/06
(52) U.S. Cl. ..... 5/99.1; 5/98.1
(58) Field of Search ..... 5/93.1, 98.1, 98.3, 5/99.1

(56) References Cited

U.S. PATENT DOCUMENTS 5,197,154 * 3/1993 Shamie ..... 5/98.3 X
5,363,521 * 11/1994 Garland et al. ..... 5/99.1
5,544,372 * 8/1996 Garland et al. ..... 5/99.1
5,906,014 * 5/1999 Zhuang ..... 5/99.1
5,911,653 * 6/1999 Cheng ..... 5/93.1 X

* cited by examiner

*Primary Examiner*—Michael F. Trettel
(74) *Attorney, Agent, or Firm*—William E. Pelton, Esq.

(57) ABSTRACT

This invention concerns a foldable frame of a playpen. The frame consists of a certain simply and quickly. The folded volume is very small in order to bring convenience in storing and transportation, and in addition, has a space defined therein to contain accessories such as boards and bed clothes.

11 Claims, 6 Drawing Sheets

FOLDABLE FRAME OF A PLAYPEN

BACKGROUND OF THE INVENTION

1. Field of the Invention

The invention relates to a foldable frame of a playpen, especially to a foldable frame which can be simply and quickly folded up and has a relatively small folded volume.

2. Description of Related Art

Playpens are favored by many parents as they can provide a safe place for a baby to rest or play.

The foldability of playpens is important because:

1. the small folded volume will be convenient for a family to store and transport it;

2. the small folded volume will also bring convenience in packing and transportation for manufacturers.

Nearly all recently developed foldable playpens have a frame made of metal poles which are connected by joints. The poles can rotate with respect to the joints to make the whole frame foldable. For example, a typical such kind of playpen has a central controlling joint at the center of the bottom of the frame, and locking joints at the middle of each of four supporting upright poles. When it is necessary to fold the playpen, the above five joints must all be released first and then the central controlling joint may be pulled upward to make the four supporting upright poles move towards the central joint.

However this kind of foldable playpen has certain drawbacks. For example, to fold the bed, a user has to release five joints, especially one on the bottom of the frame: whereby it is necessary to bend down and go round the bed at least once.

SUMMARY OF THE INVENTION

The main objective of the invention is to provide a foldable frame of a playpen having multiple poles connected by corresponding joints. The frame is able to be folded by simple actions and is able to be folded into a very small volume.

Other objects, advantages and novel features of the invention will become more apparent from the following detailed description when taken in conjunction with the accompanying drawings.

DETAILED DESCRIPTION OF THE PREFERRED EMBODIMENT

Figure 1:
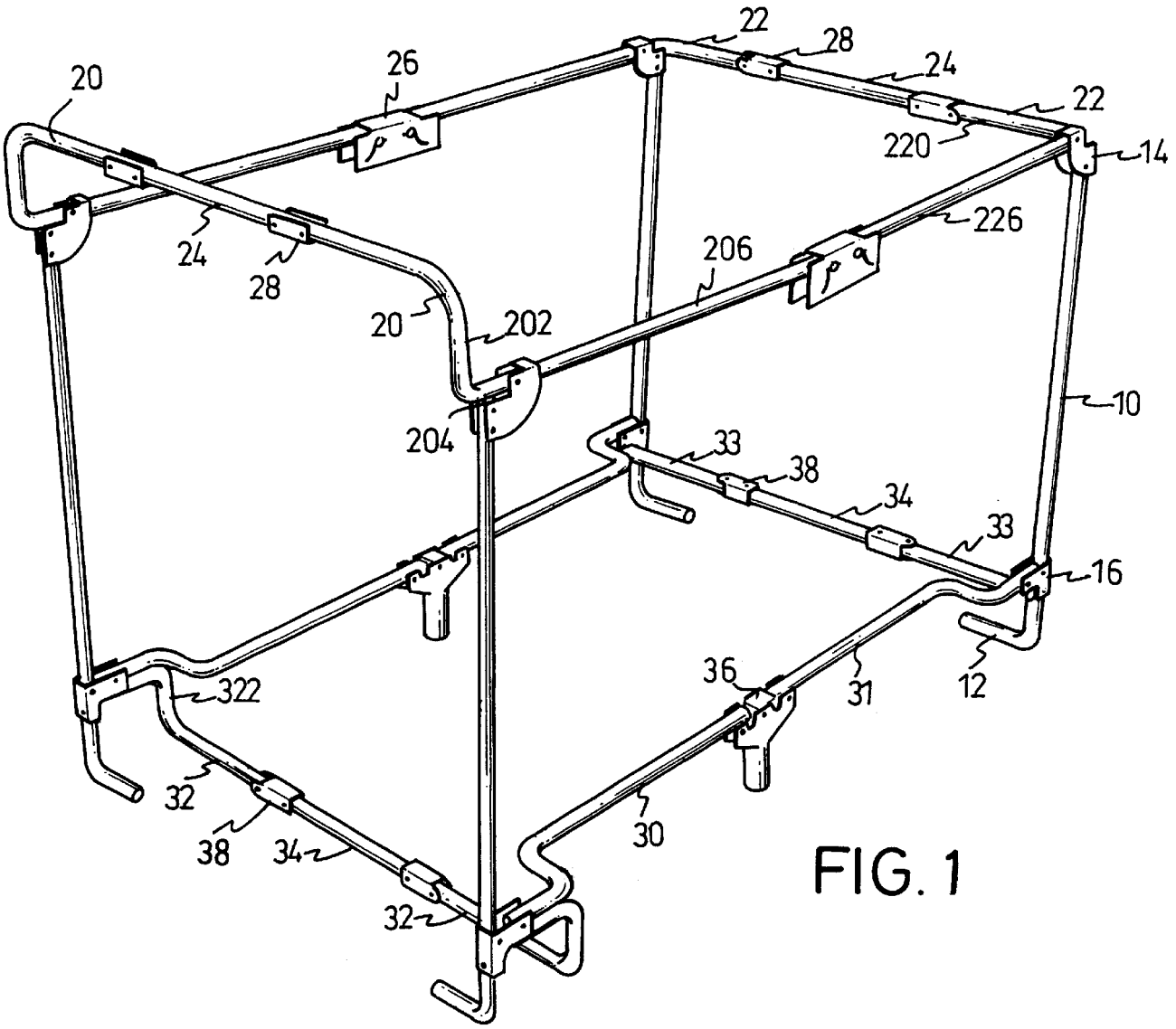
FIG. 1 is a perspective view of a frame of the invention before it is folded.
Figure 2:
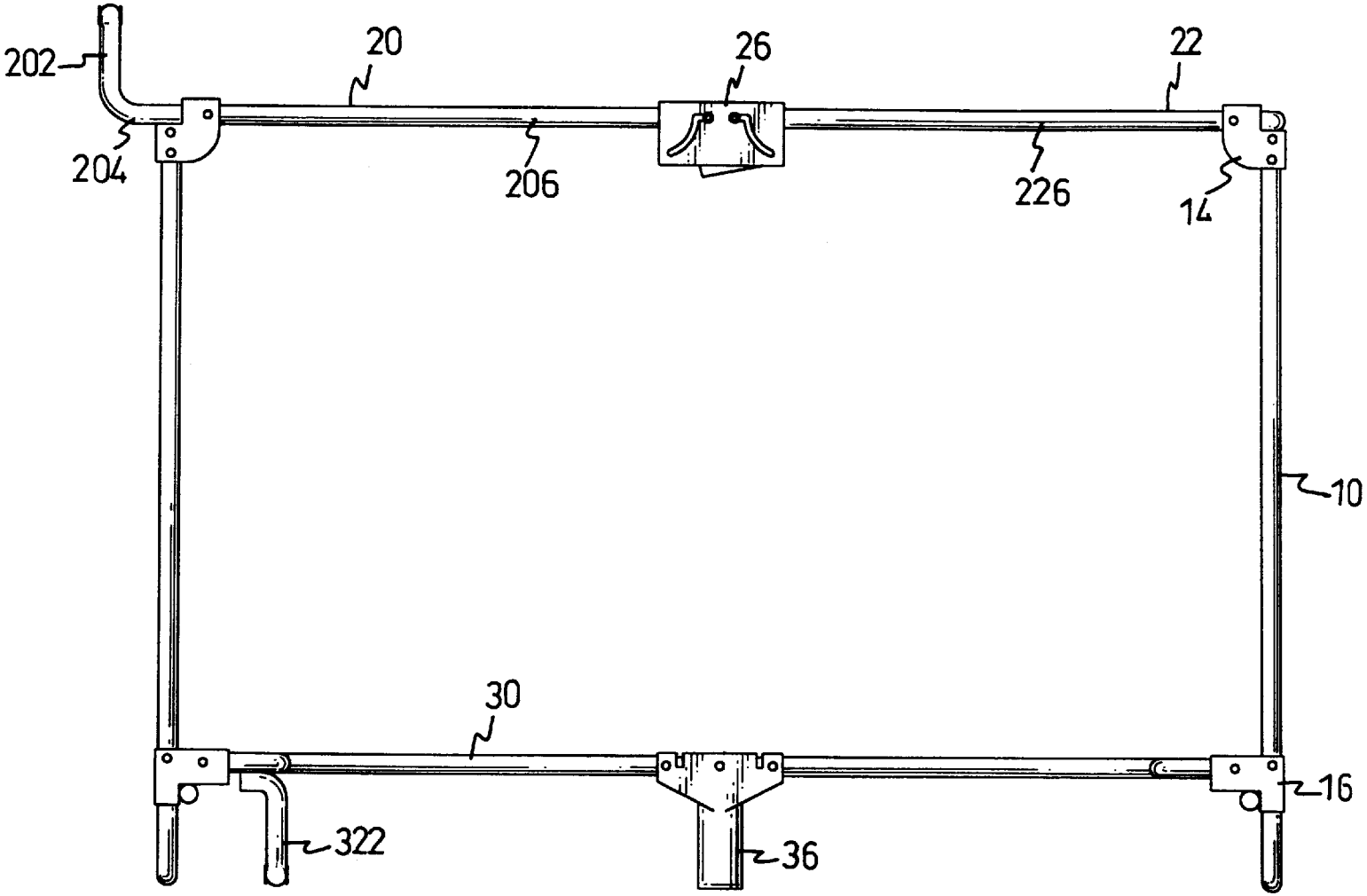
FIG. 2 is a side plan view of the frame shown in FIG. 1.

Referring to FIGS. 1 and 2, a foldable frame for a playpen in accordance with the present invention includes two opposite long sides, two opposite short sides, a top and a bottom. As the long sides are very similar, only one will be described in the detail hereinafter. The short sides comprise a front end and a rear end which are very similar and so only the front end will be described in the detail hereinafter. The long side has a top rail and a bottom rail. The short side has an upper rail and a lower rail.

Four stanchions (10) are disposed at respective corners of the playpen and provide respective joints between the long and short sides of the playpen.

Figure 3:
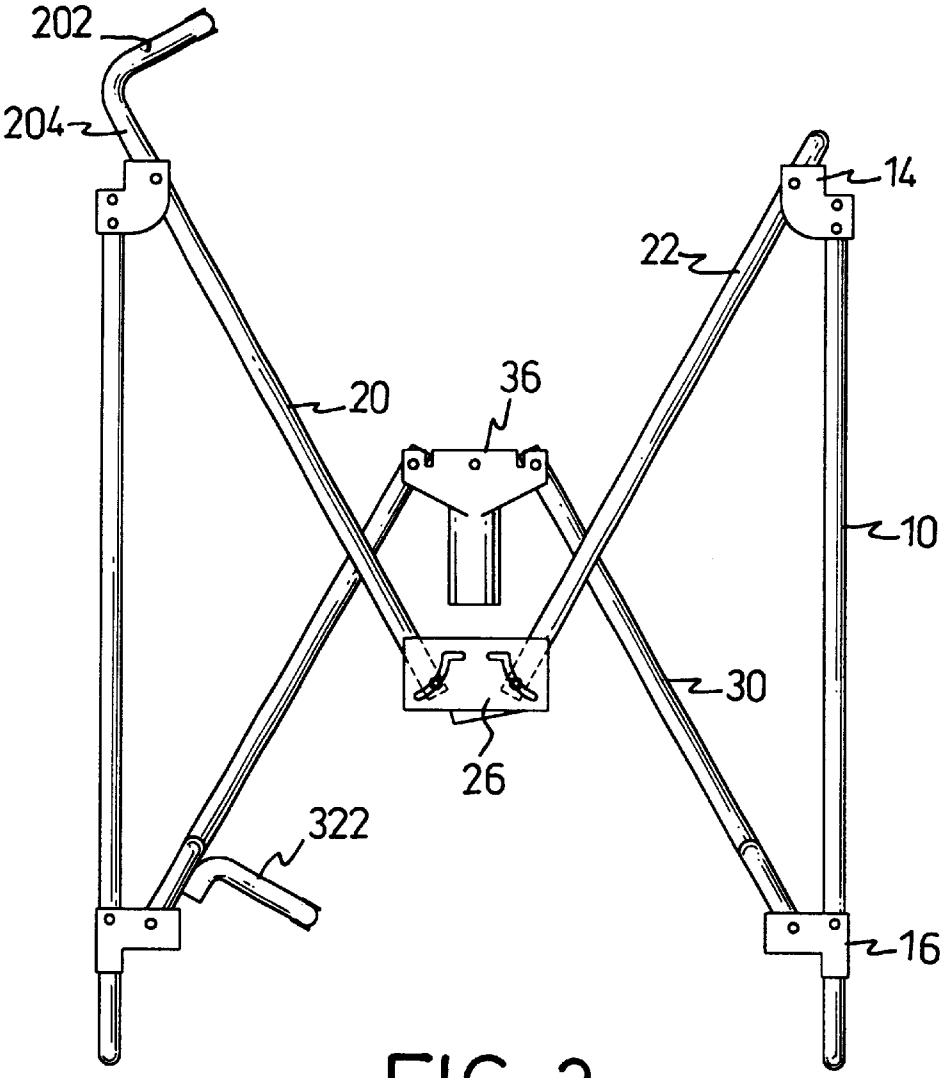
FIG. 3 is a side plan view showing the folding operation of the frame shown in FIG. 1.

Still referring to FIGS. 1 and 2, and also to FIG. 3, the top rail of the frame of the playpen comprises a left portion (206), a right portion (226), and a bracket (26) pivotally linked therebetween whereby the left portion (206) and the right portion (226) can pivot downwardly such that distal ends of each of the left and right portions (206,226) will join together when the playpen is folded. The bottom rail comprises a left member (30), a right member (31) and a 'Y'-shaped union (36) linking therebetween whereby the left member (30) and the right member (31) can pivot upwardly relative to the top rail, such that distal ends of the left and right members (30,31) will come together when the playpen is folded. The union (36) also functions as a lock to prevent the erected playpen from unintentional collapse. The distal ends of the left and right members (30,31) are substantially 'S' shaped when viewed from above. Distal tips of the left and right portions (206,226) of the top rail are pivotally linked to a respective one of a pair of junctions (14) secured to the corresponding tops of the stanchions (10). Bottom ends of the stanchions (10) are formed as 'L' shaped feet (12). The feet (12) point inward and are parallel to the bottom rail. A link (16) is fitted near a bottom of each stanchion (10) whereby each distal end of the left and right members (30,31) is pivotally secured to the respective stanchion (10).

The bottom rail has two outer tubes (32) and a central tube (34) pivotally linked therebetween by two connectors (38) disposed at opposite ends of the central tube (34), whereby distal ends of the outer tubes (32) may be swung toward each other when the playpen is folded. The distal ends of the outer tubes (32) are formed as upward legs (322) which are secured to an underside of the distal end of a respective one of the left members (30) of the bottom rail. The bottom rail further has a rear lower rail which is different from the outer tubes (32) in that distal ends of two outer tubes (33) at the rear end of the playpen are straight, but they are secured in the same manner to an underside of the distal end of a respective one of the right members (31) of the bottom rail.

The top rail includes two outer pipes (20) and a central pipe (24) pivotally linked therebetween by two hinges (28) mounted at respective ends of the central pipe (24). Distal ends of the outer pipes (20) are bent downwards to form L-shaped arm portions (202) when viewed from a side thereof.

Each tip of the arm portions (202) integrally joints with a respective one of the left portions (206) of the top rail into one piece. The outer pipes (20) and the corresponding left and right portions (206,226) of the top rail can be formed separately or as respective integral units. The top rail further has two outer pipes (22) each with a straight distal ends.

Respective bottom faces of the feet (12) and the unions (36) are on the same plane to provide stable support for the playpen in an erected, unfolded status.

The folding operation of the playpen frame is as follows.

FIG. 3 shows that after the locking devices of the unions (36) have been released, the left and right members (30,31)

of the bottom rails are brought towards each other as the unions (36) ascend to the top side of the frame. Then, the brackets (26) can be released and the left and right portions (206,226) of the top rails are brought towards each other as the brackets (26) descend toward the base of the frame.

Figure 4:
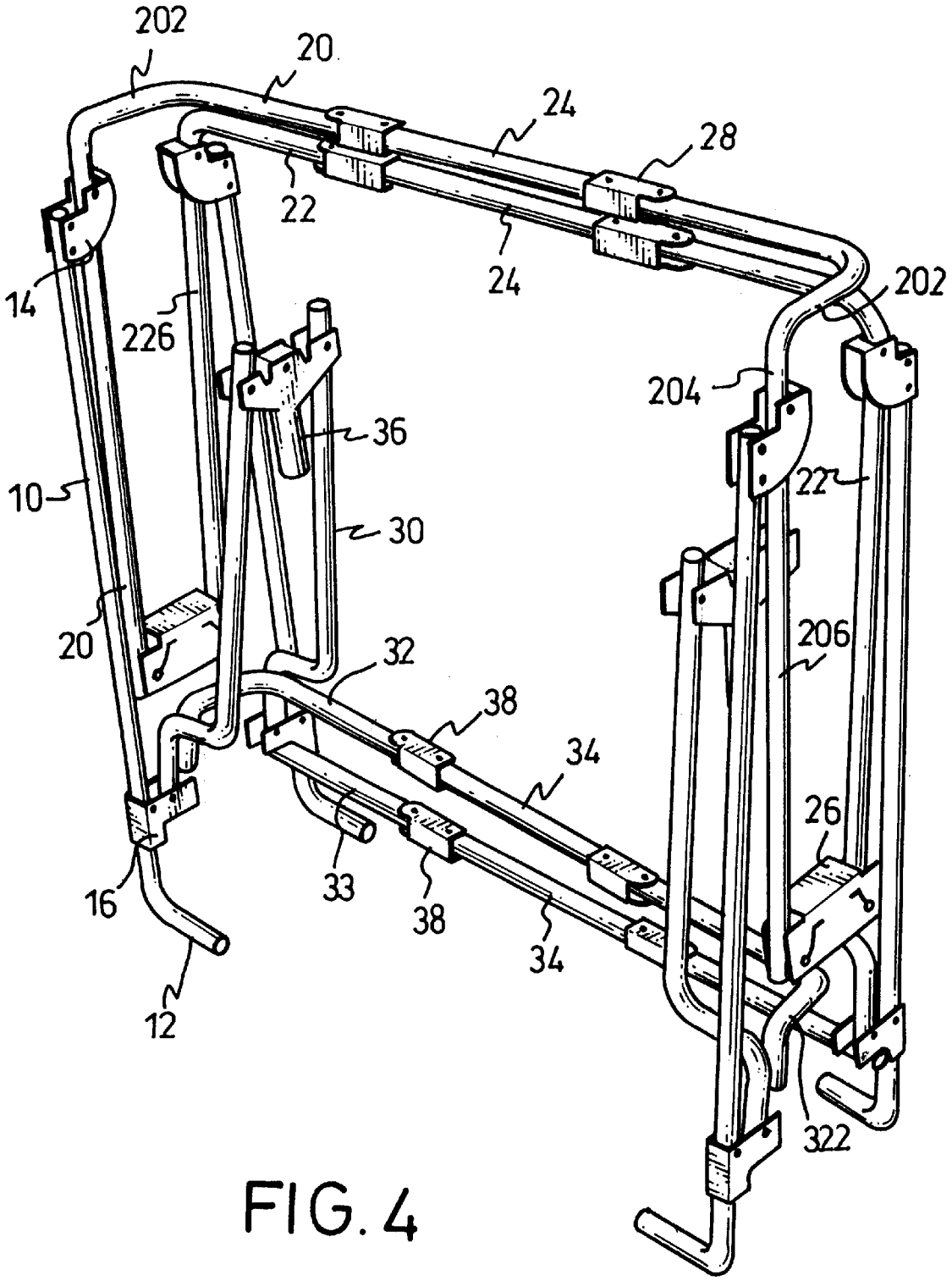
FIG. 4 is a perspective view showing the folded status after the first step of folding is completed.

FIG. 4 shows a completion of the first phase of the folding operation wherein the upper rail of the front short side rests slightly above the upper rail of the rear short side, and the lower rail of the front short side rests slightly above the lower rail of the rear short side. The right and left portions (226,206) of the top rails rest in close proximity to respective stanchions (10).

Figure 5:
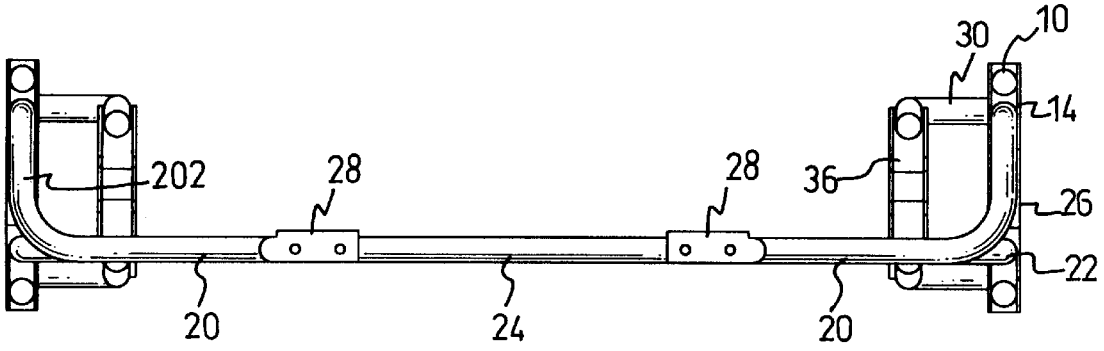
FIG. 5 is a top plan view of the folded frame as shown in FIG. 4.
Figure 6:
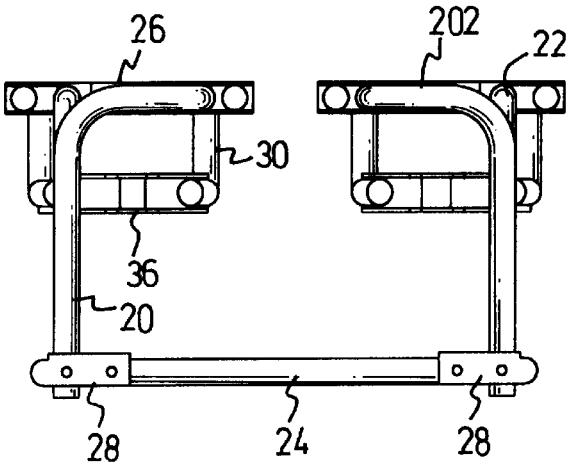
FIG. 6 is a top plan view showing the status after a second step of folding to the frame shown in FIG. 4 is competed; and, FIG. 7 is a perspective view showing the fully folded status of the frame of the invention.
Figure 7:
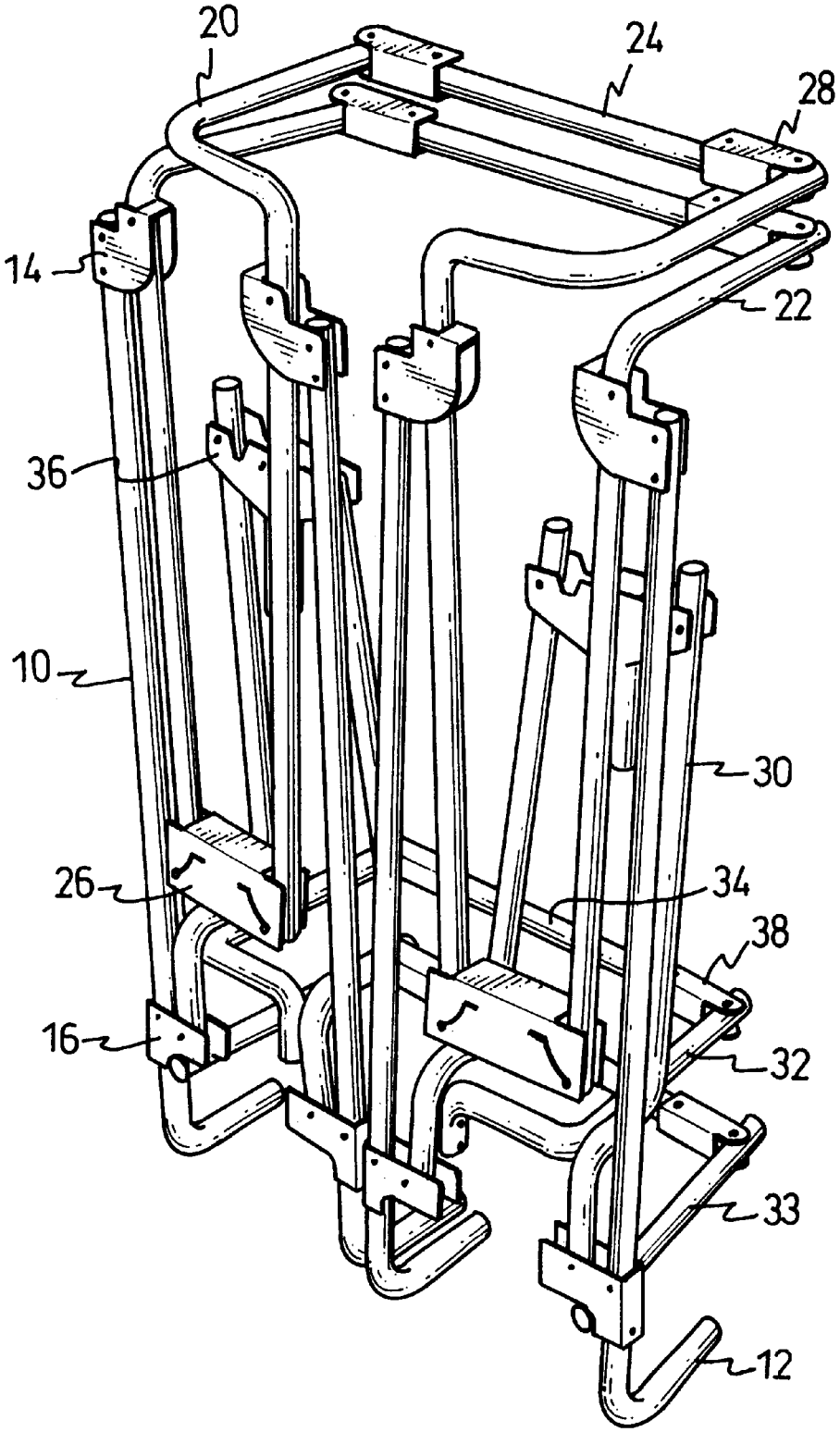

FIGS. 5, 6 and 7 show respective pairs of outer tubes (32,33) and outer pipes (20,22) of the front and rear short sides gradually pivoted towards each other, whereby the opposite top rails and opposite bottom rails are brought to close proximity with each other, resulting in a maximum reduction in volume of the playpen frame.

It is to be noted that outer pipes (20,22) of the top rail of the frame are able to pivot with respect to the respective central pipes (24) and the outer pipes (32,33) of the bottom rail of the frame are able to pivot with respect to the respective central pipes (34), such that both the top rail and the bottom rail are able to be folded to have a compact volume.

FIG. 7 also show a space (not numbered) behind the folded stanchions (10) wherein articles such as bedding may be stored. Therefore, when the frame of the playpen is folded for shipment or storage, the space occupied for each frame together with the bedding is limited to minimum so as to save a lot of expenses and space for the manufacturer.

A user can easily erect the frame by reversing the above sequence.

The invention is able to be folded and erected simply and quickly and, it also has a very small folded volume which still has a space to contain accessories such as boards and bed clothes.

It is to be understood, however, that even though numerous characteristics and advantages if the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A foldable frame for a playpen comprising:

a top rail with at least two pairs of first outer pipes, two first central pipes each pivotally engaged between two outer pipes and at least two first connecting pipes respectively and pivotally connected between the at least two pairs of first outer pipes;

four stanchions erected at corresponding corners of the frame;

a bottom rail substantially parallel with the top rail and having at least two pairs of second outer pipes each pair being pivotally connected between two adjacent stanchions, two second central pipes each pivotally engaged between two second outer pipes, and two pairs of second connecting pipes each pair being pivotally connected between distal ends of the two pairs of second outer pipes;

wherein two first outer pipes are foldable with respect to a first central pipe, and two second outer pipes are foldable with respect to a second central pipe.

2. The foldable frame for a playpen as claimed in claim 1, wherein a connecting rod is further pivotally connected between the distal end of each connecting pipe and each outer pipe.

3. The foldable frame for a playpen as claimed in claim 2, wherein the connecting rod is pivotally connected with the distal end of the connecting pipe by a bracket disposed to selectively lock the pivotal movement between the connecting pipe and the connecting rod.

4. The foldable frame for a playpen as claimed in claim 1, wherein the distal ends of one pair of the at least two pairs of first outer pipes are bent to form arm portions to be engaged with respective distal ends of the connecting pipes.

5. The foldable frame for a playpen as claimed in claim 1, wherein the first central pipe is pivotally connected with the two first outer pipes by two hinges.

6. The foldable frame for a playpen as claimed in claim 1, wherein a distal end of each of the stanchions is formed to have an L-shaped foot so as to support the frame.

7. The foldable frame for a playpen as claimed in claim 1, wherein the second central pipe is pivotally connected with the two second outer pipes by two connectors.

8. The foldable frame for a playpen as claimed in claim 1, wherein a union is provided between one pair of second connecting pipes so as to selectively lock the pivotal movement therebetween.

9. The foldable frame for a playpen as claimed in claim 8, wherein the two second outer pipes are folded first with respect to the second central pipes while the two first outer pipes are still in alignment with the first central pipe.

10. The foldable frame for a playpen as claimed in claim 1, wherein a distal end of the second connecting pipe is pivotally connected with a stanchion by a link foldable with respect to the second central pipes.

11. The foldable frame for a playpen as claimed in claim 1, wherein a junction is provided at the joint of the outer pipe, the first connecting pipe and the stanchion.

* * * * *